US009423193B2

(12) United States Patent
Gryparis

(10) Patent No.: US 9,423,193 B2
(45) Date of Patent: Aug. 23, 2016

(54) LOCK INTERFACE INSERT FOR MACHINE GUN BOLT ASSEMBLY

(71) Applicant: Christ Stratis Gryparis, Farmington Hills, MI (US)

(72) Inventor: Christ Stratis Gryparis, Farmington Hills, MI (US)

( * ) Notice: Subject to any disclaimer, the term of this patent is extended or adjusted under 35 U.S.C. 154(b) by 0 days.

(21) Appl. No.: 14/865,013

(22) Filed: Sep. 25, 2015

(65) Prior Publication Data

US 2016/0033217 A1 Feb. 4, 2016

Related U.S. Application Data

(63) Continuation of application No. 13/835,641, filed on Mar. 15, 2013, now Pat. No. 9,151,552.

(51) Int. Cl.

| | |
|---|---|
| ***F41A 3/14*** | (2006.01) |
| ***F41A 3/12*** | (2006.01) |
| ***F41A 3/36*** | (2006.01) |
| ***F41A 3/44*** | (2006.01) |
| ***F41A 5/08*** | (2006.01) |

(52) U.S. Cl.

CPC .. *F41A 3/14* (2013.01); *F41A 3/12* (2013.01); *F41A 3/36* (2013.01); *F41A 3/44* (2013.01); *F41A 5/08* (2013.01)

(58) Field of Classification Search

CPC ..... F41A 3/14; F41A 3/12; F41A 3/36; F41A 3/44; F41A 5/08

USPC ..... 89/180

See application file for complete search history.

(56) References Cited

U.S. PATENT DOCUMENTS

| | | | | | |
|---|---|---|---|---|---|
| 1,131,319 | A * | 3/1915 | Blish | F41A 3/74 | 89/17 |
| 2,585,195 | A * | 2/1952 | Walker | F41A 3/16 | 42/16 |
| 3,114,290 | A * | 12/1963 | Harvey | F41A 3/74 | 102/700 |
| 3,635,123 | A | 1/1972 | Colby | | |
| 3,848,510 | A | 11/1974 | Wolpert | | |
| 3,938,423 | A | 2/1976 | Schertz | | |
| 4,213,261 | A | 7/1980 | Claypool | | |
| 4,267,764 | A * | 5/1981 | Yaniger | F41A 17/64 | 42/106 |
| 4,677,898 | A | 7/1987 | Malhotra | | |
| 4,815,356 | A | 3/1989 | Hupp et al. | | |
| 4,974,356 | A * | 12/1990 | Kelsey, Jr. | F41A 17/36 | 42/69.03 |
| 5,398,593 | A * | 3/1995 | Sirkis | F41A 3/74 | 42/16 |
| 5,614,691 | A * | 3/1997 | Taylor | F41A 3/40 | 42/69.03 |
| 5,675,106 | A * | 10/1997 | Leiter | F41A 3/54 | 42/7 |

(Continued)

*Primary Examiner* — Michelle R Clement

(74) *Attorney, Agent, or Firm* — Carlson, Gaskey & Olds, P.C.

(57) ABSTRACT

An insert for a gun bolt according to an example of the present disclosure includes, among other things, a gun lock interface insert sized to be fixedly secured in a gun bolt. The gun lock interface insert includes a first guide structure and a second guide structure extending from a main body. The main body defines a first engagement surface and a second engagement surface. The first engagement and second engagement surfaces space apart the first guide and second guide structures. Each of the first engagement and second engagement surfaces is configured to selectively engage a breech lock. A method of repairing a bolt assembly is also disclosed.

20 Claims, 5 Drawing Sheets

(56) References Cited

U.S. PATENT DOCUMENTS 5,834,678 A 11/1998 Kalb
6,044,748 A * 4/2000 Westrom ..... F41A 15/12 42/16.1
6,182,389 B1 * 2/2001 Lewis ..... F41A 3/26 42/16
6,276,252 B1 * 8/2001 Dionne ..... F41A 3/86 42/77
6,289,619 B1 * 9/2001 Fuchs ..... F41A 19/14 42/69.03
6,442,882 B1 * 9/2002 Dionne ..... F41A 5/04 42/15
6,609,319 B1 * 8/2003 Olson ..... F41A 3/26 42/16
6,820,533 B2 * 11/2004 Schuerman ..... F41A 3/42 89/187.01
6,971,202 B2 * 12/2005 Bender ..... F41A 5/24 42/16
7,047,864 B2 * 5/2006 Spinner ..... F41A 17/42 42/70.01
7,237,469 B2 7/2007 Murello
7,287,456 B2 * 10/2007 Spielberger ..... F41A 5/12 42/14
7,721,639 B2 * 5/2010 Wossner ..... F41A 21/484 42/14
8,230,632 B2 * 7/2012 Moretti ..... F41A 3/26 42/75.01
8,490,312 B2 7/2013 Barrett et al.
8,677,883 B2 3/2014 Wössner et al.
9,068,793 B1 * 6/2015 Barrett ..... F41C 23/16
2005/0188592 A1 * 9/2005 Spinner ..... F41A 17/42 42/75.03
2005/0223613 A1 * 10/2005 Bender ..... F41A 5/24 42/16
2005/0229772 A1 10/2005 Mayerl
2007/0012170 A1 * 1/2007 Spielberger ..... F41A 5/12 89/196
2009/0019755 A1 * 1/2009 Moretti ..... F41A 3/26 42/75.01
2010/0005956 A1 1/2010 Wossner
2010/0275491 A1 * 11/2010 Leiter ..... F41A 33/02 42/76.01
2012/0131835 A1 5/2012 Barrett et al.
2012/0216439 A1 8/2012 Barrett et al.
2013/0014416 A1 1/2013 Sisgold
2013/0047833 A1 2/2013 Steimke et al.
2013/0192114 A1 8/2013 Christenson
2015/0276338 A1 * 10/2015 Lewis ..... F41A 3/12 89/188

* cited by examiner

LOCK INTERFACE INSERT FOR MACHINE GUN BOLT ASSEMBLY

CROSS-REFERENCE TO RELATED APPLICATION

This disclosure is a continuation of U.S. patent application Ser. No. 13/835,641 filed Mar. 15, 2013.

BACKGROUND

This disclosure relates to short recoil weapons, and more particularly to the Browning M2 0.50 caliber (including all variants) and Browning 1919 0.30 caliber machine guns.

Short recoil weapons are generally configured to lock a bolt and a barrel together for a predetermined distance to ensure that energy produced by a fired cartridge is dissipated to a safe level prior to opening a breech. Prior to firing, a breech lock disposed in the barrel extension selectively engages a corresponding locking surface of the bolt (also described as the bolt lock interface), locking the bolt and barrel together. After the round is fired, the bolt, barrel extension and barrel travel together the predetermined distance. Then the breech lock disengages the bolt allowing the bolt to accelerate toward the rear of the receiver independently of the barrel.

While the bolt and the barrel are locked together and after the weapon is fired, a substantial portion of the recoil force is communicated to the locking surface of the bolt adjacent to the breech lock recess. Accordingly, a common wear point is the locking surface due to high cyclic rates of fire. After the amount of wear of the locking surface exceeds a predetermined wear threshold, the weapon may become dysfunctional or unsafe for use. Accordingly, even though only a small portion of the bolt is worn or distressed beyond allowable limits, the entire bolt is generally discarded.

SUMMARY

An insert for a gun bolt according to an example of the present disclosure includes a gun lock interface insert sized to be fixedly secured in a gun bolt. The gun lock interface insert includes a first guide structure and a second guide structure extending from a main body. The main body defines a first engagement surface and a second engagement surface. The first engagement and second engagement surfaces space apart the first guide and second guide structures. Each of the first engagement and second engagement surfaces is configured to selectively engage a breech lock.

In a further embodiment of any of the forgoing embodiments, the main body includes a first surface spaced apart from a second surface, and first and second surfaces spacing apart the first engagement and second engagement surfaces. A cross-sectional profile of the gun lock interface insert is generally trapezoidal. The cross-sectional profile is defined by each of the first and second surfaces, the first engagement and second engagement surfaces, and the first guide and second guide structures.

In a further embodiment of any of the forgoing embodiments, each of the first guide and second guide structures is sized to be slideably received in a corresponding channel of a barrel extension.

A lock interface insert for a gun bolt according to an example of the present disclosure includes a main body dimensioned to bound a breech lock recess defined in a gun bolt. The main body defines at least one engagement surface configured to engage a breech lock selectively received within the breech lock recess, and at least two outward guides extending from the main body and sized to be slideably received in a corresponding channel of a barrel extension.

In a further embodiment of any of the forgoing embodiments, each of the at least two outward guides is adjacent to the at least one engagement surface.

In a further embodiment of any of the forgoing embodiments, each of the at least two outward guides defines a bevel sloping towards the at least one engagement surface.

In a further embodiment of any of the forgoing embodiments, the at least one engagement surface includes a first engagement surface and a second engagement surface opposite the first engagement surface.

In a further embodiment of any of the forgoing embodiments, the main body defines a reference plane intersecting the at least two outward guides, and the first engagement and second engagement surfaces are arranged such that the main body is symmetrical about the reference plane.

In a further embodiment of any of the forgoing embodiments, each of the at least two outward guides is symmetrical about the reference plane.

In a further embodiment of any of the forgoing embodiments, a cross section of the main body taken transverse to the at least one engagement surface defines a trapezoidal geometry.

A method of repairing a bolt assembly according to an example of the present disclosure includes the steps of removing a portion of material adjacent to an engagement surface of a bolt to define a shaped cavity, providing a lock interface insert, and fixedly securing the lock interface insert at least partially within the shaped cavity. The lock interface insert includes a main body dimensioned to bound a breech lock recess adjacent to the shaped cavity. The main body defines at least one engagement surface configured to engage a breech lock selectively received within the breech lock recess.

In a further embodiment of any of the forgoing embodiments, the step of fixedly securing includes forming an interference fit to minimize relative movement between the lock interface insert and the bolt.

In a further embodiment of any of the forgoing embodiments, the step of inserting includes press fitting the lock interface insert in the shaped cavity.

In a further embodiment of any of the forgoing embodiments, the step of inserting includes inserting the lock interface insert completely within the shaped cavity.

In a further embodiment of any of the forgoing embodiments, the portion of material is adjacent to the breech lock recess.

In a further embodiment of any of the forgoing embodiments, the bolt defines a top and a bottom extending between a first bolt end and a second bolt end, and the shaped cavity is spaced apart from at least one of the top and the bottom.

In a further embodiment of any of the forgoing embodiments, the lock interface insert includes at least two outward guides extending from the main body. Each of at least two outward guides is sized to be slideably received in a corresponding channel of a barrel extension.

In a further embodiment of any of the forgoing embodiments, at least one engagement surface includes a first engagement surface and a second engagement surface opposite the first engagement surface.

A further embodiment of any of the foregoing embodiments includes removing the lock interface insert from the shaped cavity and fixedly securing the lock interface insert at least partially within the shaped cavity such that a different one of the first engagement surface and the second engagement surface bounds the breech lock recess.

In a further embodiment of any of the forgoing embodiments, a cross section of the main body taken transverse to the first engagement surface and the second engagement surface defines a trapezoidal geometry.

These and other features disclosed herein can be best understood from the following specification and drawings, the following of which is a brief description.

DETAILED DESCRIPTION

Figure 1:
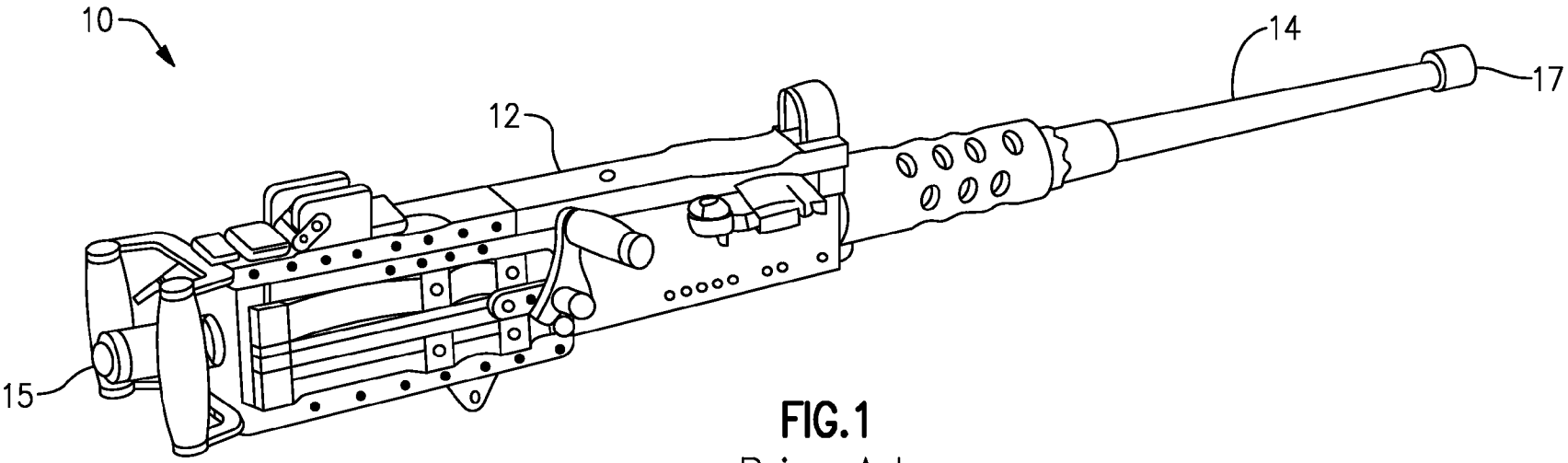
FIG. 1 Prior Art
FIG. 1 is a perspective view of a prior art machine gun.

FIG. 1 illustrates a perspective view of prior art machine gun 10, and more particularly an M2 0.50 caliber machine gun. The machine gun 10 includes a receiver 12 disposed at a first weapon end 15 and a barrel 14 disposed at a second weapon end 17. The receiver 12 includes a chamber 13 for receiving a bolt and a barrel extension 16 (shown in FIG. 3). The components of the machine gun 10 are well known.

Figure 2:
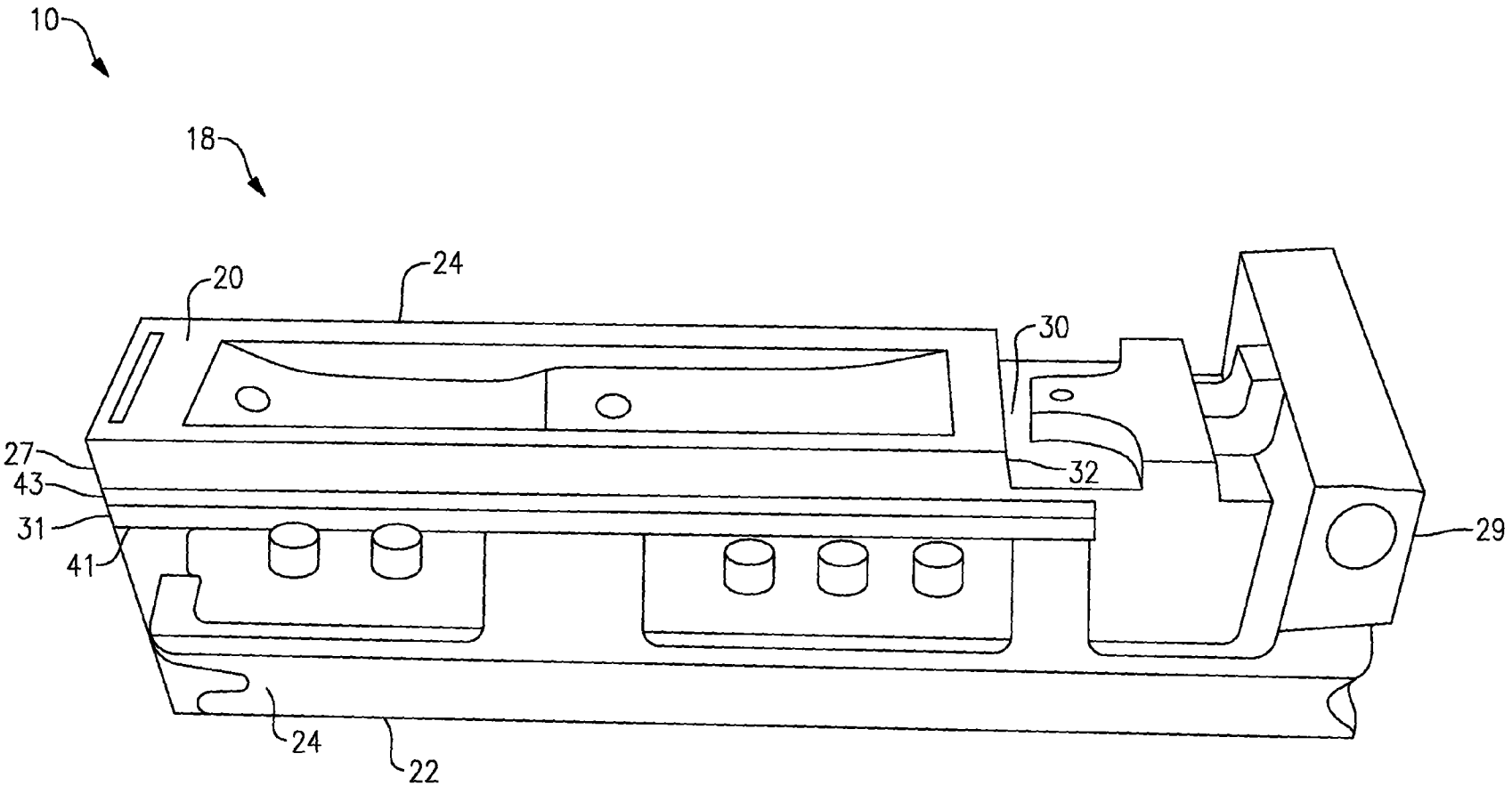
FIG.2 Prior Art
FIG. 2 is a bottom view of a bolt of the prior art machine gun of FIG. 1.

FIG. 2 illustrates a bottom view of a bolt 18 of a prior art machine gun 10. The prior art bolt 18 includes a first bolt end 27 and a second bolt end 29. The bolt 18 is configured to be partially received in a barrel extension 16 (not shown). The bolt 18 includes a pair of rails 31 extending outward from a pair of lateral sides 24 between the first and second bolt ends 27, 29. The rails 31 include an upper surface 41 and a lower surface 43 each parallel to a bottom 20 and a top 22 of the bolt 18. The rails 31 are configured to be slideably received in a pair of corresponding channels of the barrel extension 16 (not shown). The bolt 18 also defines a breech lock recess 30 extending inward from the bottom 20 of the bolt 18 for receiving a breech lock 26 (shown in FIG. 3).

Figure 3:
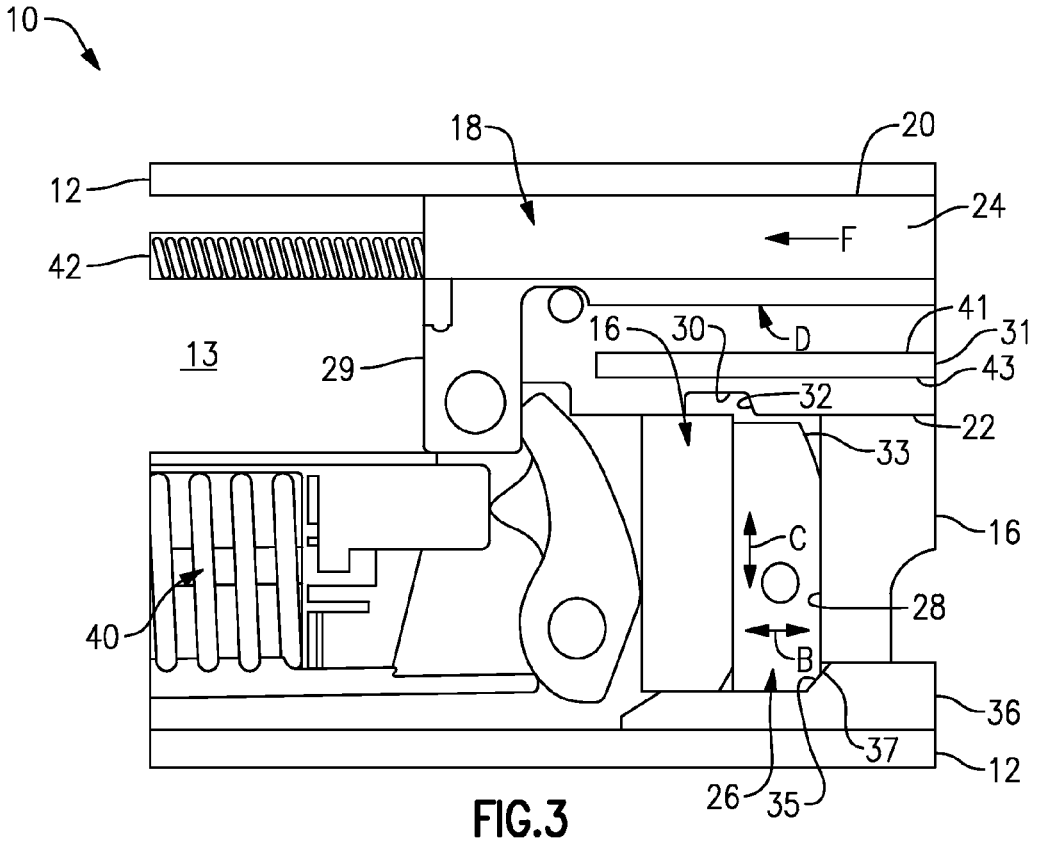
FIG.3 Prior Art
FIG. 3 is a partial side view of the bolt of the prior art machine gun of FIG. 1, the bolt in an installed and unlocked position.

FIG. 3 illustrates a partial side view of the bolt 18 and barrel extension 16 installed in the receiver 12. The breech lock 26 is disposed within an inner cavity 28 defined by the barrel extension 16. The breech lock 26 is free to move within the inner cavity 28 in a direction C. A receiver 12 includes a ramp 36 with a breech lock cam 37 for engaging a locking cam 35 of the breech lock 26. During counter-recoil, the barrel extension 16 moves in a direction B with respect to the ramp 36, causing the breech lock 26 to engage the breech lock cam 37. The breech lock 26 extends upward in the direction C toward the breech lock recess 30. The breech lock 26 engages the lock interface 32 of the bolt 18 adjacent to the breech lock recess 30, causing the bolt 18 and the barrel extension 16 to lock together.

Figure 4:
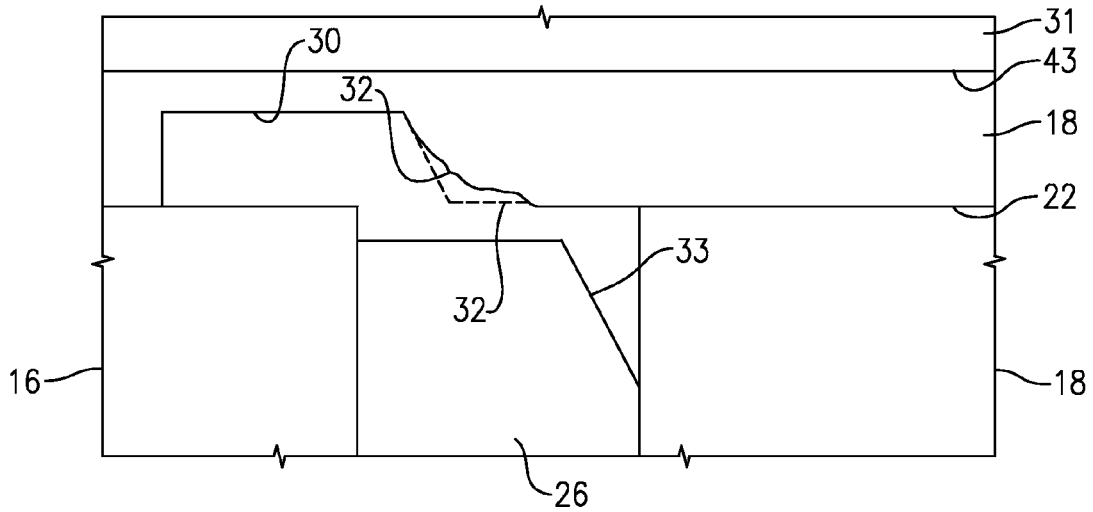
FIG. 4 is a partial side view of a worn surface of the bolt of the prior art machine gun of FIG. 3.

When the machine gun 10 is fired, a portion of a recoil force F is absorbed by a barrel buffer spring 40 and a driving rod spring 42. However, a significant amount of the recoil force F is communicated to the lock interface 32 while the bolt 18 is locked to the barrel extension 16 by the breech lock 26. Additionally, the recoil force F causes the bolt 18 to be driven in a slightly diagonal direction D along a bolt engagement surface 33 of the breech lock 26 when the bolt 18 and the barrel extension 16 are locked together. Accordingly, the lock interface 32 begins to wear as the machine gun 10 fires (shown in FIG. 4). After the amount of wear of the lock interface 32 exceeds a certain threshold, the operation of the machine gun 10 becomes unreliable. The operation of the machine gun 10 is well known.

Figure 5:
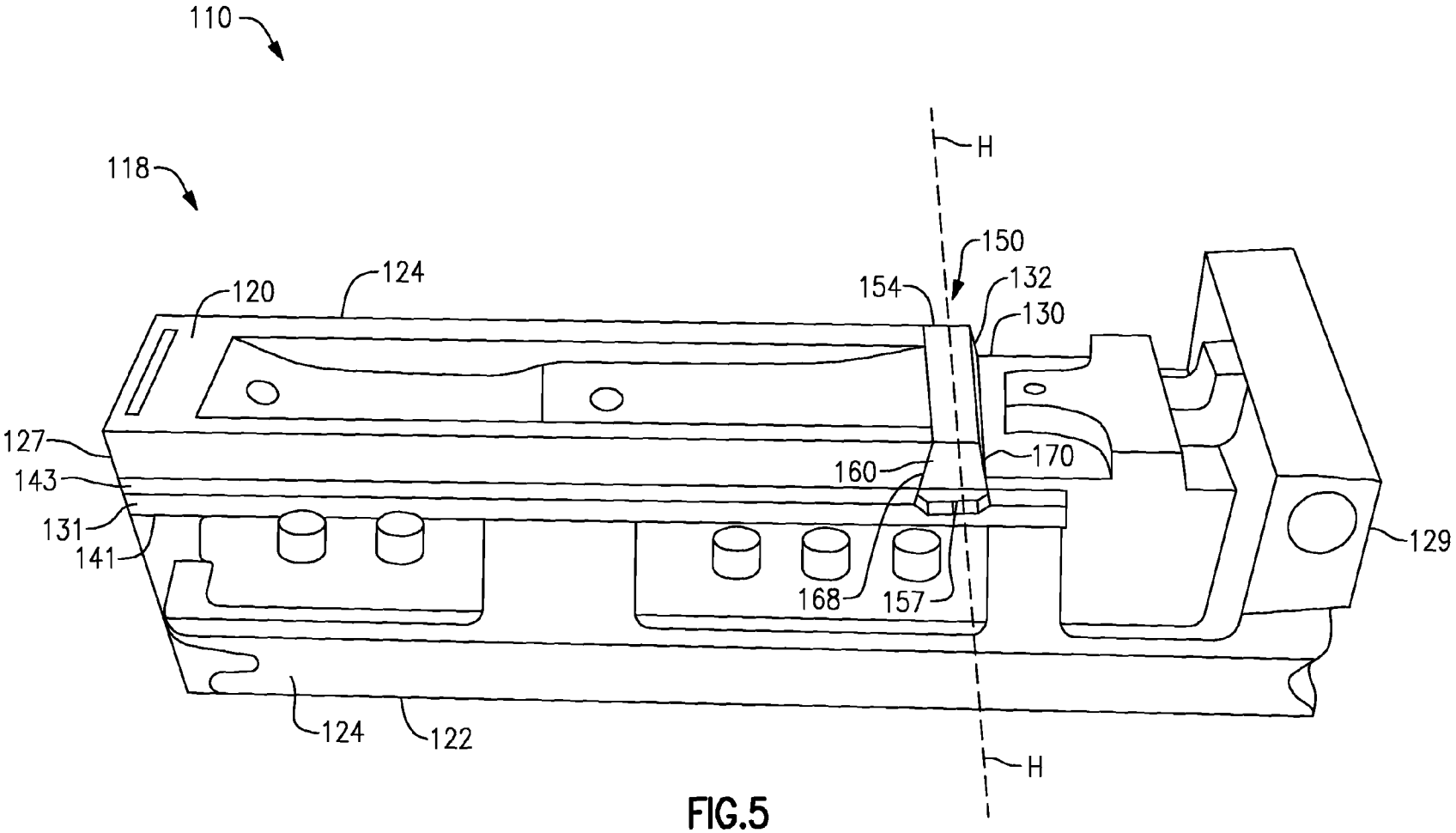
FIG. 5 is a bottom view of a lock interface insert installed in a bolt.
Figure 6:
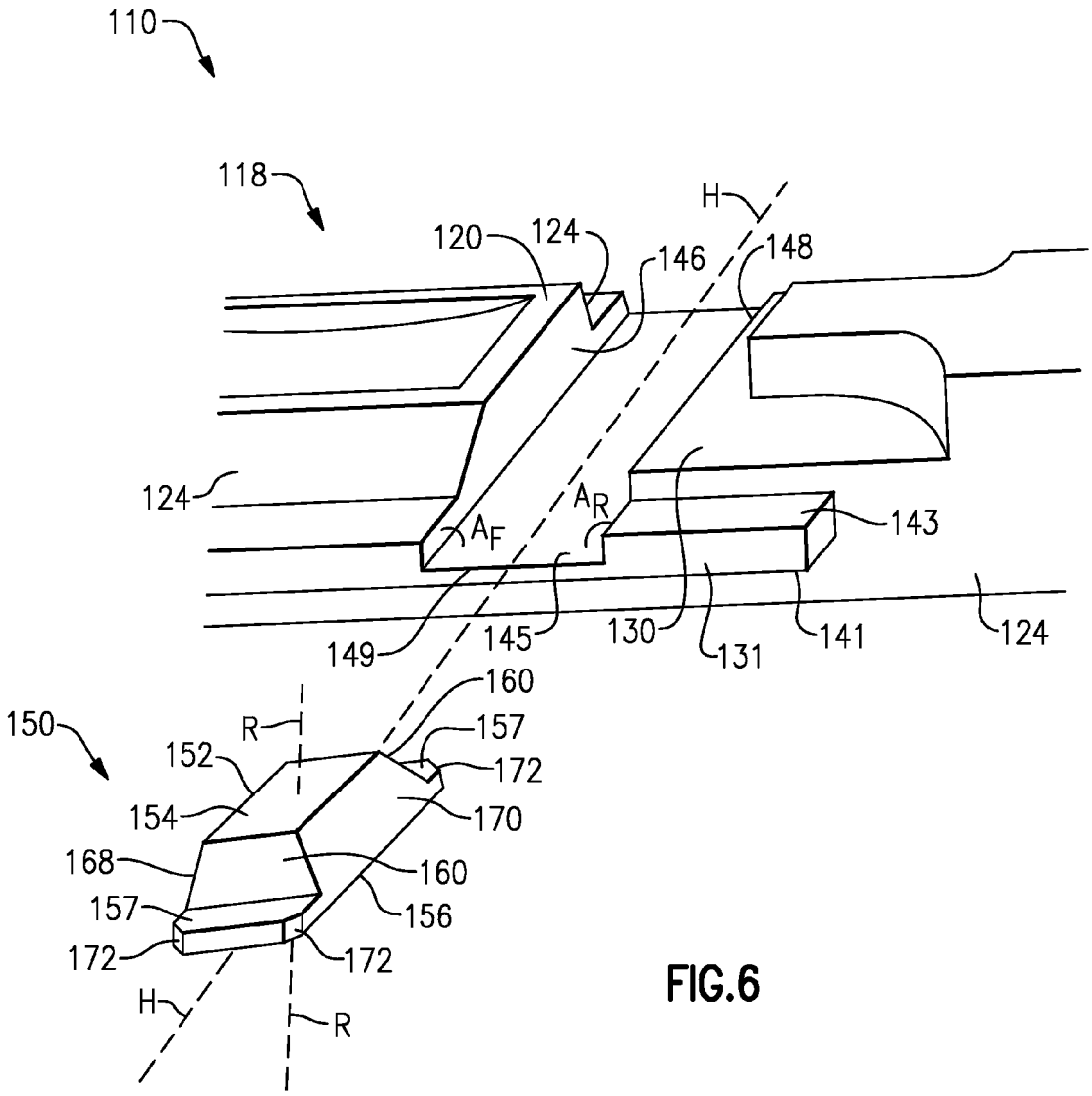
FIG. 6 is a perspective view of the bolt and the lock interface insert of FIG. 5 in an uninstalled position.

FIG. 5 illustrates a bottom view of a bolt 118 and a lock interface insert 150 in an installed position. FIG. 6 illustrates a bottom perspective view of a portion of the bolt 118 and the lock interface insert 150 of FIG. 5 with the lock interface insert 150 in an uninstalled position. In this disclosure, like reference numerals designate like elements where appropriate and reference numerals with the addition of one-hundred or multiples thereof designate modified elements that are understood to incorporate the same features and benefits of the corresponding original elements.

As shown in FIG. 6, the bolt 118 defines a shaped cavity 145 for receiving a portion of the lock interface insert 150. The shaped cavity 145 extends between a forward surface 146 and a rear surface 148 of the bolt 118 along a horizontal axis H and adjacent to the breech lock recess 130. The forward surface 146 defines a forward angle $A_F$ and the rear surface 148 defines a rear angle $A_R$ with respect to a floor 149 of the shaped cavity 145. Each of the angles $A_F$, $A_R$ is generally acute. The floor 149 extends at least partially between the upper and lower surfaces 141, 143 of the rails 131, which serve to guide the bolt's 118 movement with respect to the barrel extension 16.

The lock interface insert 150 includes a main body 152. The main body 152 includes a first insert surface 154 configured to form a flush and continuous surface with the bottom 20 the bolt 118 (shown in FIG. 5) to engage the receiver 12. The main body 152 includes a second insert surface 156 substantially parallel to the first insert surface 154 and adjacent to the floor 149 of the bolt 118 when the lock interface insert 150 is placed within the shaped cavity 145. The main body 152 includes a pair of first sides 160 opposite each other and adjacent to the first and second insert surfaces 154, 156. The first sides 160 are configured to form a flush and continuous surface with the lateral sides 124 of the bolt 118 (shown in FIG. 5).

The main body 152 includes a front engagement surface 168 and a rear engagement surface 170 opposite each other for selectively engaging the breech lock 26. The front and rear engagement surfaces 168, 170 are disposed between the first and second insert surfaces 154, 156. The front engagement surface 168 is generally oriented at the forward angle $A_F$ and the rear engagement surface 170 is generally oriented at the rear angle $A_R$ with respect to the second insert surface 156. The front engagement surface 168 is configured to be substantially parallel to the forward surface 146 of the bolt 118, and the rear engagement surface 170 is configured to be substantially parallel to the rear surface 148 of the bolt 118. The rear engagement surface 170 may be configured to be substantially parallel to the bolt engagement surface 33 to redirect a portion of the recoil force F (shown in FIG. 3) perpendicularly from the rear engagement surface 170 and into the bolt engagement surface 33 of the breech lock 26.

As shown in FIG. 5, a cross section of the lock interface insert 150 is generally trapezoidal. The forward and rear angles $A_F$, $A_R$ of the shaped cavity 145 may be substantially equal to each other and generally acute. This allows the lock interface insert 150 to be held captive in the shaped cavity 145 by the forward and rear surfaces 146, 148 of the bolt 118 and minimizes the possibility that the lock interface insert 150 may become dislodged during operation of the machine gun 110. As shown in FIG. 6, the lock interface insert 150 is symmetrical along the horizontal axis H and can be inserted into the shaped cavity 145 with either the front or rear engagement surfaces 168, 170 facing the breech lock 26. However, other shapes and configurations of the lock interface insert 150 are contemplated.

The lock interface insert 150 includes a pair of outward guides 157 extending outward from the main body 152 along the horizontal axis H. The outward guides 157 are adjacent to the second insert surface 156 of the main body 152 and form a flush and continuous surface with the rails 131 of the bolt 118 when the lock interface insert 150 is installed in the shaped cavity 145. Each of the outward guides 157 may include a pair of bevels 172 for realigning the lock interface insert 150 within the shaped cavity 145 along the horizontal axis H. Realignment occurs by engagement of the bevels 172 with an interior surface of the corresponding channels (not shown) of the barrel extension 16. The bevels 172 also facilitate the insertion of the lock interface insert 150 into the shaped cavity 145. The outward guides 157 may be integrally formed with the main body 152.

The shaped cavity 145 and the lock interface insert 150 may be configured to form an interference fit when lock interface insert 150 is slide fitted along the horizontal axis H. Accordingly, no fasteners are required to secure the lock interface insert 150 within the shaped cavity 145. The outward guides 157 also keep the lock interface insert 150 locked in place.

The lock interface insert 150 can be formed by machining, forging, casting or other methods depending on materials used and fitting specifications. The lock interface insert 150 may be formed from a second material including steel, alloy or other metals depending on military specifications and other requirements. The second material of the lock interface insert 150 may have a greater hardness than a first material of the bolt 118. The second material of the lock interface insert 150 may also be different from the first material of the bolt 118 in metallurgy. Forming the bolt 118 and the lock interface insert 150 from different materials allows each of the components to be separately optimized according to performance requirements, cost and other parameters.

Installation of the lock interface insert 150 is as follows. A portion of the prior art bolt 18 adjacent to the lock interface 32 (shown in FIGS. 2-4) is removed to define the shaped cavity 145 (shown in FIG. 5). Removal of the portion of the prior art bolt 18 may be performed by methods generally known in the art including machining. In another embodiment, the shaped cavity 145 is formed during the manufacturing process. Thereafter, the lock interface insert 150 is inserted into the shaped cavity 145 along the horizontal axis H. The lock interface insert 150 may be press fit into the shaped cavity 145 with a conventional insertion tool (not shown).

When the rear engagement surface 170 wears beyond the predetermined wear threshold, the operator may reverse the orientation of the lock interface insert 150 by removing the lock interface insert 150 from the shaped cavity 145, rotating the lock interface insert 150 about a rotational axis R (shown in FIG. 6), and reinserting the lock interface insert 150 into the shaped cavity 145 with the front engagement surface 168 adjacent to the breech lock 26 (shown in FIG. 5). In this way, the advantage of a lock interface insert feature may be extended. Additionally, a sufficient amount of the rear engagement surface 170 is configured to extend below the breech lock recess 130 (shown in FIG. 5) even though a portion of the surface 170 is worn. The remaining portion of the rear engagement surface 170 is able to contact the forward surface 146 of the bolt 118 when the lock interface insert 150 is rotated to retain the lock interface insert 150 within the shaped cavity 145. The operator may discard the lock interface insert 150 to be replaced by another lock interface insert once both the front and rear engagement surfaces 168, 170 are worn.

Accordingly, the lock interface insert 150 provides several benefits over the prior art bolt 18. Only the lock interface insert 150 is discarded after the surfaces 168, 170 are worn beyond a predetermined wear threshold rather than the entire bolt 18. The bolt 118 is field reparable by replacement of the lock interface insert 150. Accordingly, a lower quantity of bolts may be kept in inventory and the repair time of the bolt is reduced. Additionally, the front and rear engagement surfaces 168, 170 of the lock interface insert 150 provide two separate wear surfaces, prolonging the duration between servicing of the bolt 118.

Although the different embodiments have the specific components shown in the illustrations, embodiments of this disclosure are not limited to those particular combinations. It is possible to use some of the components or features from one of the embodiments in combination with features or components from another one of the embodiments.

The preceding description is exemplary rather than limiting in nature. Variations and modifications to the disclosed embodiments may become apparent to those skilled in the art that do not necessarily depart from the essence of this disclosure. The scope of legal protection given to this disclosure can only be determined by studying the following claims.

What is claimed is:

1. A insert for a gun bolt, comprising:

a gun lock interface insert sized to be fixedly secured in a gun bolt, said gun lock interface insert including a first guide structure and a second guide structure extending from a main body, said main body defining a first engagement surface and a second engagement surface, said first engagement and second engagement surfaces spacing apart said first guide and said second guide structures, wherein each of said first engagement and second engagement surfaces is configured to selectively engage a breech lock.

2. The insert as recited in claim 1, wherein:

said main body includes a first surface spaced apart from a second surface, and first and second surfaces spacing apart said first engagement and second engagement surfaces;

a cross-sectional profile of said gun lock interface insert is generally trapezoidal; and said cross-sectional profile is defined by each of said first and second surfaces, said first engagement and second engagement surfaces, and said first guide and said second guide structures.

3. The insert as recited in claim 1, wherein each of said first guide and second guide structures is sized to be slideably received in a corresponding channel of a barrel extension.

4. A lock interface insert for a gun bolt, comprising:

a main body dimensioned to bound a breech lock recess defined in a gun bolt, said main body defining at least one engagement surface configured to engage a breech lock selectively received within the breech lock recess; and at least two outward guides extending from said main body and sized to be slideably received in a corresponding channel of a barrel extension.

5. The lock interface insert as recited in claim 4, wherein each of said at least two outward guides is adjacent to said at least one engagement surface.

6. The lock interface insert as recited in claim 5, wherein each of said at least two outward guides defines a bevel sloping towards said at least one engagement surface.

7. The lock interface insert as recited in claim 4, wherein said at least one engagement surface includes a first engagement surface and a second engagement surface opposite said first engagement surface.

8. The lock interface insert as recited in claim 7, wherein said main body defines a reference plane intersecting said at least two outward guides, and said first engagement and said second engagement surfaces are arranged such that said main body is symmetrical about said reference plane.

9. The lock interface insert as recited in claim 8, wherein each of said at least two outward guides is symmetrical about said reference plane.

10. The lock interface insert as recited in claim 7, wherein a cross section of said main body taken transverse to said at least one engagement surface defines a trapezoidal geometry.

11. A method of repairing a bolt assembly comprising the steps of:

removing a portion of material adjacent to an engagement surface of a bolt to define a shaped cavity;

providing a lock interface insert, said lock interface insert comprising:

a main body dimensioned to bound a breech lock recess adjacent to said shaped cavity, said main body defining at least one engagement surface configured to engage a breech lock selectively received within said breech lock recess; and fixedly securing said lock interface insert at least partially within said shaped cavity.

12. The method as recited in claim 11, wherein the step of fixedly securing includes forming an interference fit to minimize relative movement between said lock interface insert and said bolt.

13. The method as recited in claim 11, wherein the step of inserting includes press fitting said lock interface insert in said shaped cavity.

14. The method as recited in claim 11, wherein the step of inserting includes inserting said lock interface insert completely within said shaped cavity.

15. The method as recited in claim 11, wherein the portion of material is adjacent to said breech lock recess.

16. The method as recited in claim 11, wherein said bolt defines a top and a bottom extending between a first bolt end and a second bolt end, and said shaped cavity is spaced apart from at least one of said top and said bottom.

17. The method as recited in claim 11, wherein said lock interface insert includes at least two outward guides extending from said main body, each of said at least two outward guides sized to be slideably received in a corresponding channel of a barrel extension.

18. The method as recited in claim 11, wherein said at least one engagement surface includes a first engagement surface and a second engagement surface opposite said first engagement surface.

19. The method as recited in claim 18, comprising:

removing said lock interface insert from said shaped cavity; and fixedly securing said lock interface insert at least partially within said shaped cavity such that a different one of said first engagement surface and said second engagement surface bounds said breech lock recess.

20. The method as recited in claim 19, wherein a cross section of said main body taken transverse to said first engagement surface and said second engagement surface defines a trapezoidal geometry.

* * * * *